US012059106B2

(12) United States Patent
Wachala

(10) Patent No.: US 12,059,106 B2
(45) Date of Patent: Aug. 13, 2024

(54) TOOTHPASTE DISPENSING DEVICE

(71) Applicant: Marsha Wachala, Balingup (AU)

(72) Inventor: Marsha Wachala, Balingup (AU)

( * ) Notice: Subject to any disclaimer, the term of this patent is extended or adjusted under 35 U.S.C. 154(b) by 143 days.

(21) Appl. No.: 17/996,025

(22) PCT Filed: Apr. 26, 2021

(86) PCT No.: PCT/AU2021/050375
§ 371 (c)(1),
(2) Date: Oct. 12, 2022

(87) PCT Pub. No.: WO2021/217199
PCT Pub. Date: Nov. 4, 2021

(65) Prior Publication Data

US 2023/0190050 A1 Jun. 22, 2023

(30) Foreign Application Priority Data

Apr. 27, 2020 (AU) ..... 2020901317

(51) Int. Cl.
*A47K 5/18* (2006.01)
*B65D 35/28* (2006.01)
*B65D 35/56* (2006.01)

(52) U.S. Cl.
CPC ..... *A47K 5/18* (2013.01); *B65D 35/28* (2013.01); *B65D 35/56* (2013.01)

(58) Field of Classification Search
CPC ..... B65D 35/28; B65D 35/56; A47K 2201/00
See application file for complete search history.

(56) References Cited

U.S. PATENT DOCUMENTS 3,180,528 A * 4/1965 Balint ..... B65D 51/242 222/105
5,035,385 A * 7/1991 Markham ..... A47K 1/09 248/108

(Continued)

FOREIGN PATENT DOCUMENTS

CA 2170419 A1 * 7/1997 ..... A47K 5/18
CN 201481244 U 5/2010

(Continued)

OTHER PUBLICATIONS

International Preliminary Report on Patentability dated Dec. 3, 2021 from PCT Application No. PCT/AU2021/050375.

(Continued)

*Primary Examiner* — Paul R Durand
*Assistant Examiner* — Randall A Gruby
(74) *Attorney, Agent, or Firm* — INNOVATION CAPITAL LAW GROUP, LLP; Vic Lin

(57) ABSTRACT

A toothpaste dispensing device has an elongate body defining an upper section for accommodating at least a portion of a toothpaste container longitudinally therein in use and a lower section defining a toothbrush entrance therethrough. A dispensing mechanism is located within the lower section. The dispensing mechanism comprises a pump mechanism engaging a mouth of the toothpaste container and a trigger pivotally coupled to act on the pump mechanism. The trigger is accessible via the toothbrush entrance such that, in use, when a toothbrush head is inserted into the toothbrush entrance, the toothbrush head deflects the trigger thereby causing the trigger to act on the pump mechanism to dispense toothpaste from the toothpaste container onto the toothbrush head located thereunderneath.

26 Claims, 6 Drawing Sheets

(56) References Cited

U.S. PATENT DOCUMENTS

| | | | | |
|---|---|---|---|---|
| 5,165,988 | A | 11/1992 | Schaefer | |
| 5,305,922 | A | 4/1994 | Varon | |
| 6,789,701 | B1 * | 9/2004 | Smith | A47K 5/18 222/464.2 |

FOREIGN PATENT DOCUMENTS

| | | | | |
|---|---|---|---|---|
| CN | 207996168 | U | 10/2018 | |
| CN | 109677723 | * | 4/2019 | A47K 5/00 |
| EP | 0017941 | A1 | 10/1980 | |
| KR | 2020090000781 | U | 1/2009 | |
| WO | 2012015190 | A2 | 2/2012 | |
| WO | 2015152561 | A1 | 10/2015 | |

OTHER PUBLICATIONS

International Search Report & Written Opinion dated Jul. 19, 2021 from PCT Application No. PCT/AU2021/050375.

* cited by examiner

TOOTHPASTE DISPENSING DEVICE

FIELD OF THE INVENTION

This invention relates generally to toothpaste dispensing devices.

BACKGROUND

Various forms of toothpaste dispensing devices comprise a dispensing mechanism actuated by a toothbrush to dispense toothpaste from a toothpaste container.

For example, CN 201481244 U (GUANGZHE LI) 26 May 2010 discloses a toothpaste squeezer having a wall attachable plate 11 and chassis 2, 12 attachable thereto concealing a dispensing mechanism therein which engages a toothpaste container 1. When the chassis 2, 12 is assembled, a cover tube 10 may be screwably affixed to threading defined therebetween to conceal the toothpaste container 1.

U.S. Pat. No. 5,305,922 A (VARON) 26 Apr. 1994 discloses a dispenser having a toothpaste container removably mounted on a stationary base with a dispensing nozzle for discharging paste therethrough, either under pressurisation or mechanised pump.

WO 2012/015190 A2 (WOO JAE-GUM) 2 Feb. 2012 discloses a toothpaste dispenser comprising bifurcated case portions 112, 114 which conceal a pump mechanism therebetween and from which a toothpaste container is exposed thereabove.

The present invention seeks to provide a toothpaste dispensing device, which will overcome or substantially ameliorate at least some of the deficiencies of the prior art, or to at least provide an alternative

SUMMARY OF THE DISCLOSURE

According to one aspect, a toothpaste dispensing device comprises an elongate body defining an upper section for accommodating at least a portion of a toothpaste container longitudinally therein in use and a lower section defining a toothbrush entrance therethrough. A dispensing mechanism is located within the lower section. The dispensing mechanism comprises a pump mechanism engaging a mouth of the toothpaste container and a trigger pivotally coupled to act on the pump mechanism.

The trigger is accessible via the toothbrush entrance such that, in use, when a toothbrush head is inserted into the toothbrush entrance, the toothbrush head deflects the trigger thereby causing the trigger to act on the pump mechanism to dispense toothpaste from the toothpaste container onto the toothbrush head located thereunderneath.

Furthermore, the body comprises a cover portion and a rear portion which releasably connect at respective peripheral edges thereof. The cover portion defines the toothbrush entrance.

The cover and rear portions define an elongate interior therebetween when connected which is sufficient to completely accommodate the toothpaste container within the peripheral edges therein in use when the cover and rear portions are connected.

The rear portion defines a rear planar surface at least rearward of the trigger for conforming attachment to a vertical surface in use.

As such, in contradistinction to the above prior art arrangements, the present device can be attached to a wall surface by the planar rear surface wherein the cover and rear portions completely conceal the toothpaste container between the respective peripheral edges thereof. Furthermore, the toothpaste container is easily accessible for replenishment by quickly and conveniently pulling the cover portion from the rear portion to expose the toothpaste container for removal whilst the rear portion remains affixed to the wall surface and wherein the cover portion may be quickly and conveniently subsequently reattached to the rear portion once the toothpaste container is replenished.

Whereas only GUANGZHE LI appears concerned with containing the toothpaste container, unlike the arrangement of GUANGZHE LI which requires a separate cover tube to be installed to conceal the toothpaste container therein and which must be unscrewed for accessing the toothpaste container, the present arrangement allows for the relatively quicker and more simple pulling of the cover portion from the rear portion to access the toothpaste container.

Furthermore, the present toothpaste entrance may define an edge for pulling the cover portion from the rear portion. As such, a finger may be inserted up into the toothpaste entrance to pull the cover portion from the rear portion. Furthermore, the pump mechanism may be concealed above an upper edge of the toothpaste entrance with the trigger extending thereunderneath in front of the toothpaste entrance which may allow a void for insertion of one's finger for pulling the cover portion from the rear portion.

The cover and rear portions preferably connect without mechanical-type fasteners. Preferably, the cover and rear portions magnetically attract such as by comprising respective collocating attractive magnetic fasteners arranged along the respective peripheral edges thereof. As such, the cover portion may be easily pulled from the rear portion (without applying excessive force to the rear portion which may cause the rear portion to inadvertently detach from the wall surface) and wherein the cover portion easily snaps back onto the rear portion by magnetic attraction.

The pump mechanism may comprise a mouth engagement into which a mouth of the toothpaste container inserts or which can be screwed.

In a preferred embodiment, the pump mechanism engaged by the rear portion such that the pump mechanism and the toothpaste container can be simultaneously and suited to engage the rear portion or removed from the rear portion when the pump mechanism in the toothpaste container are connected.

As such, for example, for replenishing the toothpaste container, the cover portion may be removed and the toothpaste container and the pump mechanism may be pulled simultaneously whilst connected from the rear portion. Thereafter, the toothpaste container mouth may be unscrewed from the mechanism and replaced with a fresh toothpaste container which may be then reinserted whilst connected to the pump mechanism. The rear portion may define spaced apart ribs and the pump mechanism may define side projections that tightly fit within the spaced apart ribs to prevent movement of the pump mechanism along and elongate axis of the body in use. The ribs may be orientated orthogonally with respect to the elongate axis to allow the pump mechanism to be pulled from the rear portion when the cover portion is removed.

Furthermore, the trigger may engage the pump mechanism so that there trigger mechanism can stay in place when the pump mechanism is inserted or removed. Specifically, the trigger may define side pivot that pivotally engage the rear portion and fulcrum engagements that act reciprocally on a lower face of the pump mechanism. The fulcrum engagements may be configured such that, when the trigger is not activated, the fulcrum engagements do not hinder the lower face to interfere with the pump mechanism been removed.

The trigger may be concave with respect to the toothbrush entrance and may comprise peripheral sides which guide the toothbrush head therebetween.

In embodiments, the toothpaste container defines front and rear shell which seal together at a continuous peripheral edge to maximise the toothpaste storage volume between the cover and rear portions.

The rear piece may comprise spacer flanges which appropriately locate the toothpaste container within the interior of the device.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
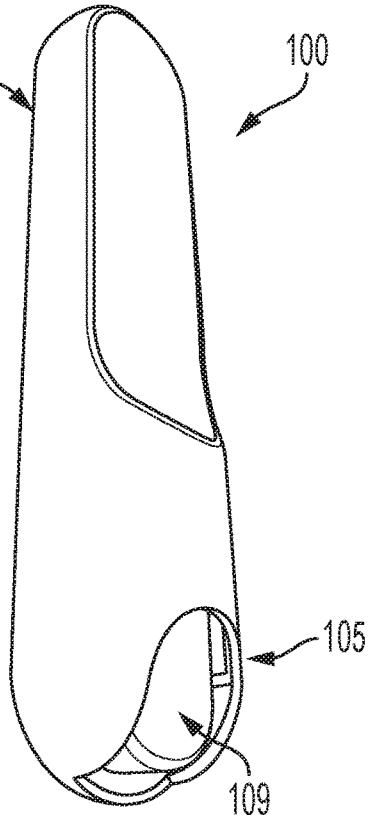
FIG. 1 shows a front perspective view of a toothpaste dispensing device in accordance with an embodiment.
Figure 2:
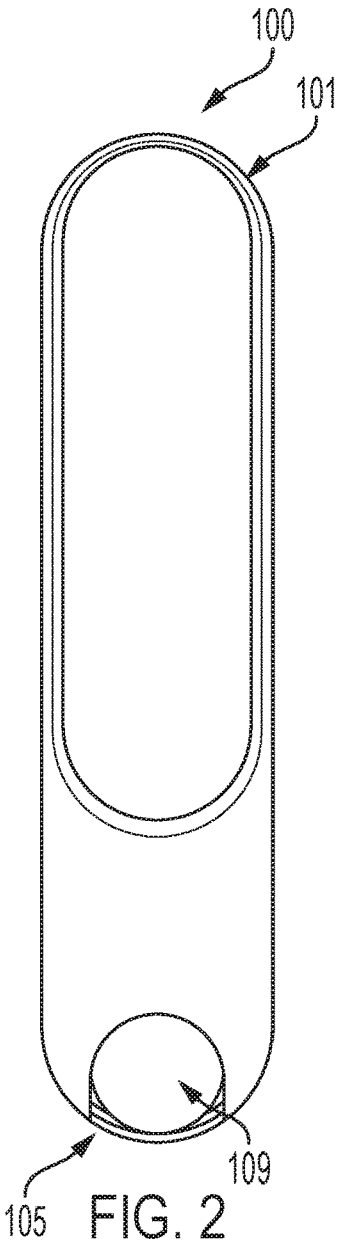
FIG. 2 shows a front elevation view of the toothpaste dispensing device.

A toothpaste dispensing device 100 comprises an elongate body 101 comprising an upper section 102 for accommodating at least a portion of a toothpaste container 103 longitudinally therein in use and a lower section 104.

The lower section 104 defines a toothbrush entrance 105.

The device 100 further comprises a dispensing mechanism 106 comprising a pump mechanism 107 engaging a mouth of the toothpaste container 103.

The dispensing mechanism 106 further comprises a trigger 109 pivotally coupled to act on the pump mechanism 107. The trigger 109 is accessible via the toothbrush entrance 105 such that, in use, when a toothbrush head is inserted into the toothbrush entrance 105, the toothbrush head deflects the trigger 109, thereby causing the trigger 109 to act on the pump mechanism 107 to dispense toothpaste from the toothpaste container 103 onto the toothbrush head located thereunderneath.

The body 101 comprises a cover portion 110 and a rear portion 111 having respective peripheral edges 112 which releasably connect. The cover portion 110 defines the toothbrush entrance 105. Furthermore, the cover and rear portions 110, 111 define an elongate interior 113 when connected. The elongate interior 113 is sufficient to completely accommodate the toothpaste container 103 within the peripheral edges 112 therein in use when the cover and rear portions 110, 111 are connected.

The rear portion 111 defines a rear planar surface 114 at least rearward of the trigger 109 for conforming attachment to a vertical surface in use, such as a bathroom mirror.

Figure 3:
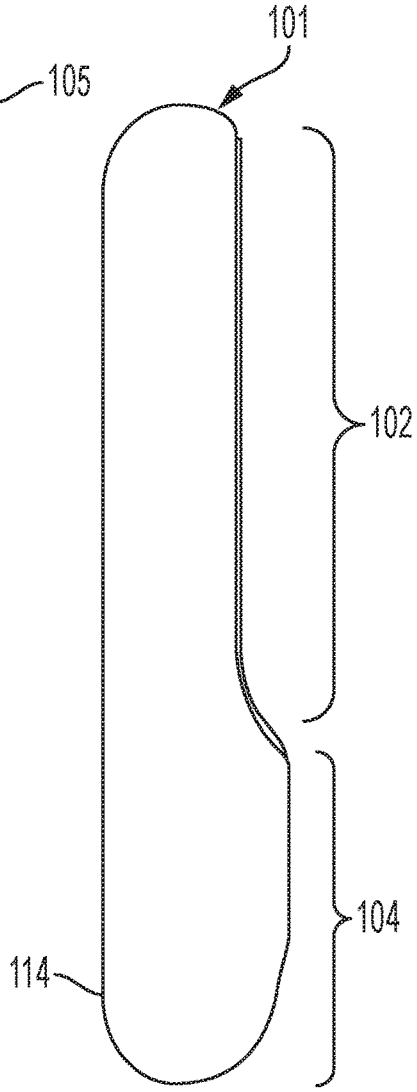
FIG. 3 shows a side elevation view of the toothpaste dispensing device.

Whereas the rear planar surface 114 is rearward of the trigger 109 to withstand force applied thereto by the toothbrush head, the rear planar surface 114 may be substantially along most of the entire length of the rear portion 111 as shown in FIG. 3 to increase the adhesion contact surface area of the device 100.

Figure 6:
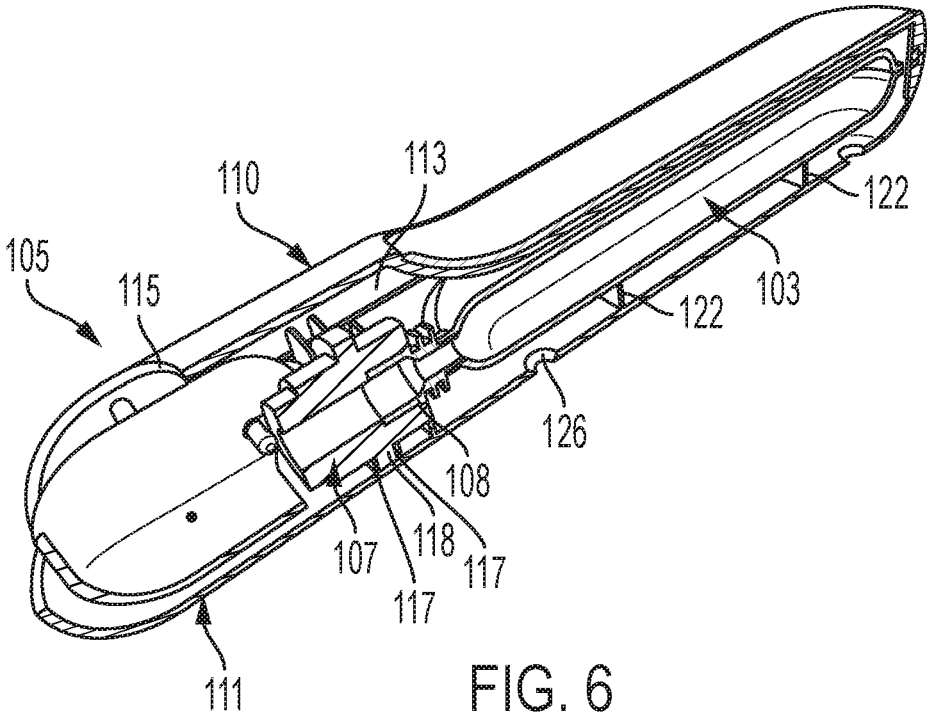
FIGS. 6 and 7 show cross-sectional side perspective views of the toothpaste dispensing device.
Figure 7:
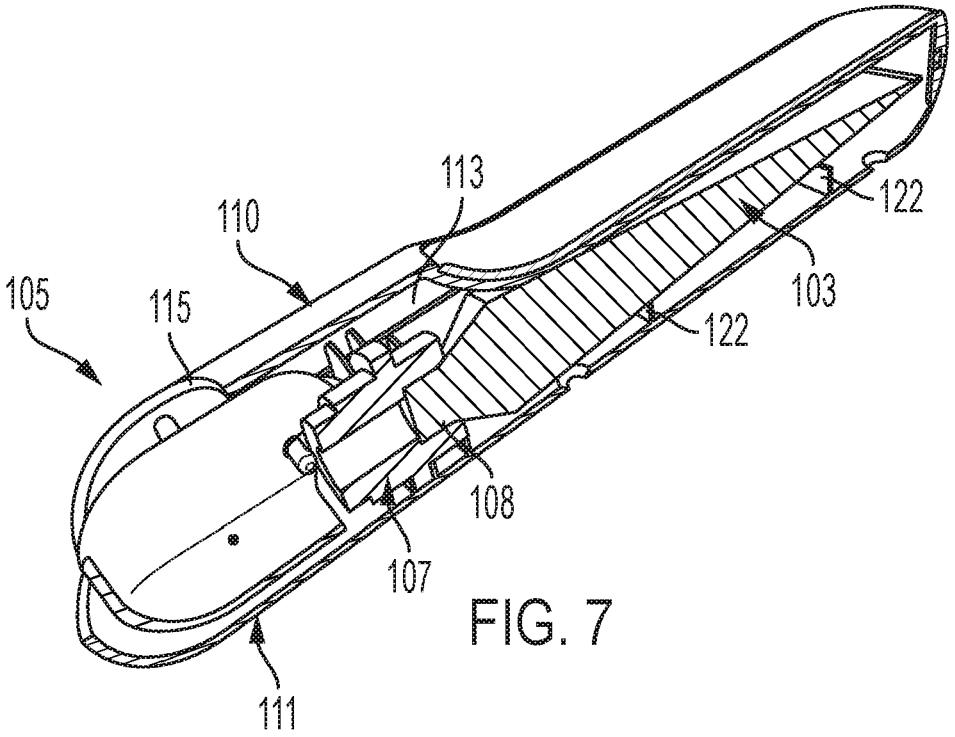
Figure 8:
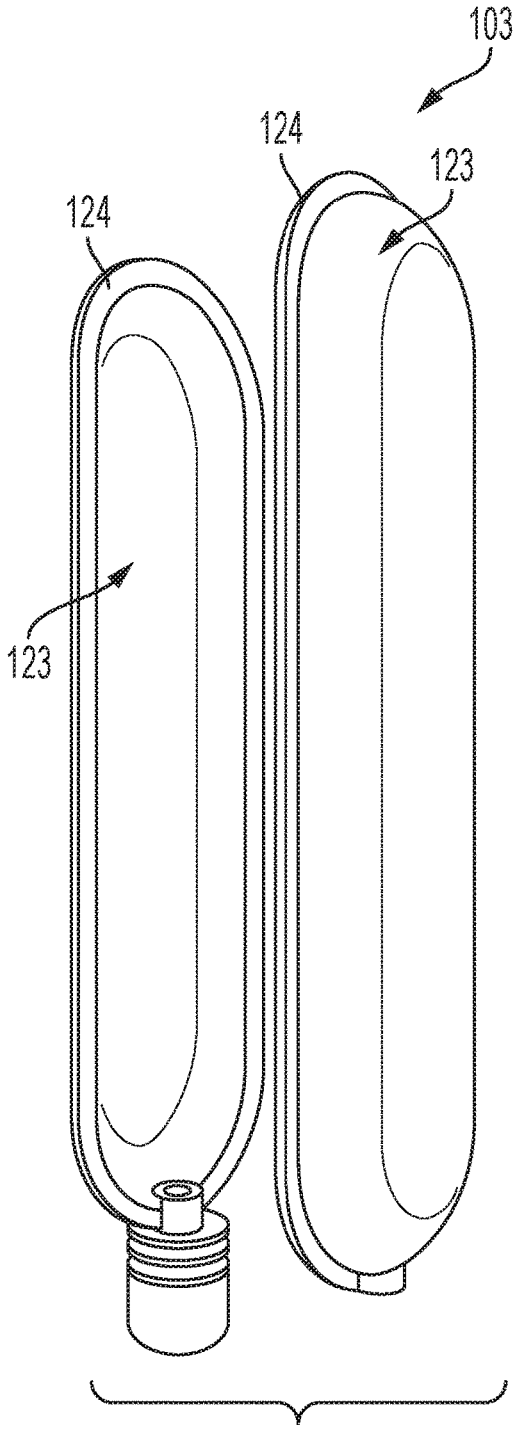
FIG. 8 shows a toothpaste container in accordance with an embodiment.

Referencing FIGS. 6 and 7, the cover portion 110 may define an edge 115 which can be pulled to cause the cover portion 110 to release from the rear portion 111. The edge 115 may be defined by an edge of the toothbrush entrance 105, such as the upper edge thereof. As such, a finger may be inserted into the toothbrush entrance 105 to engage the upper edge 115 to pull the cover portion 110 from the rear portion.

The cover and rear portions preferably connect without mechanical-type fasteners. Preferably, the cover and rear portions magnetically attract each other.

Figure 4:
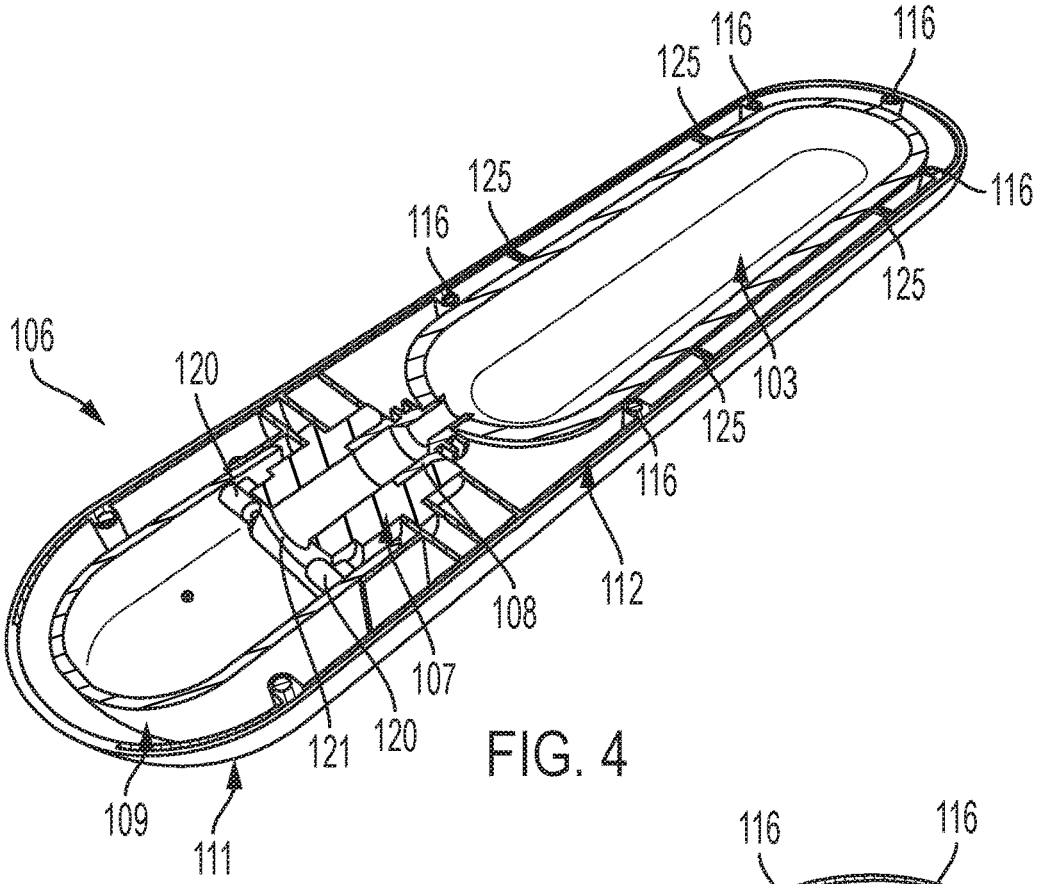
FIG. 4 shows a cross-sectional rear perspective view of the toothpaste dispensing device.
Figure 5:
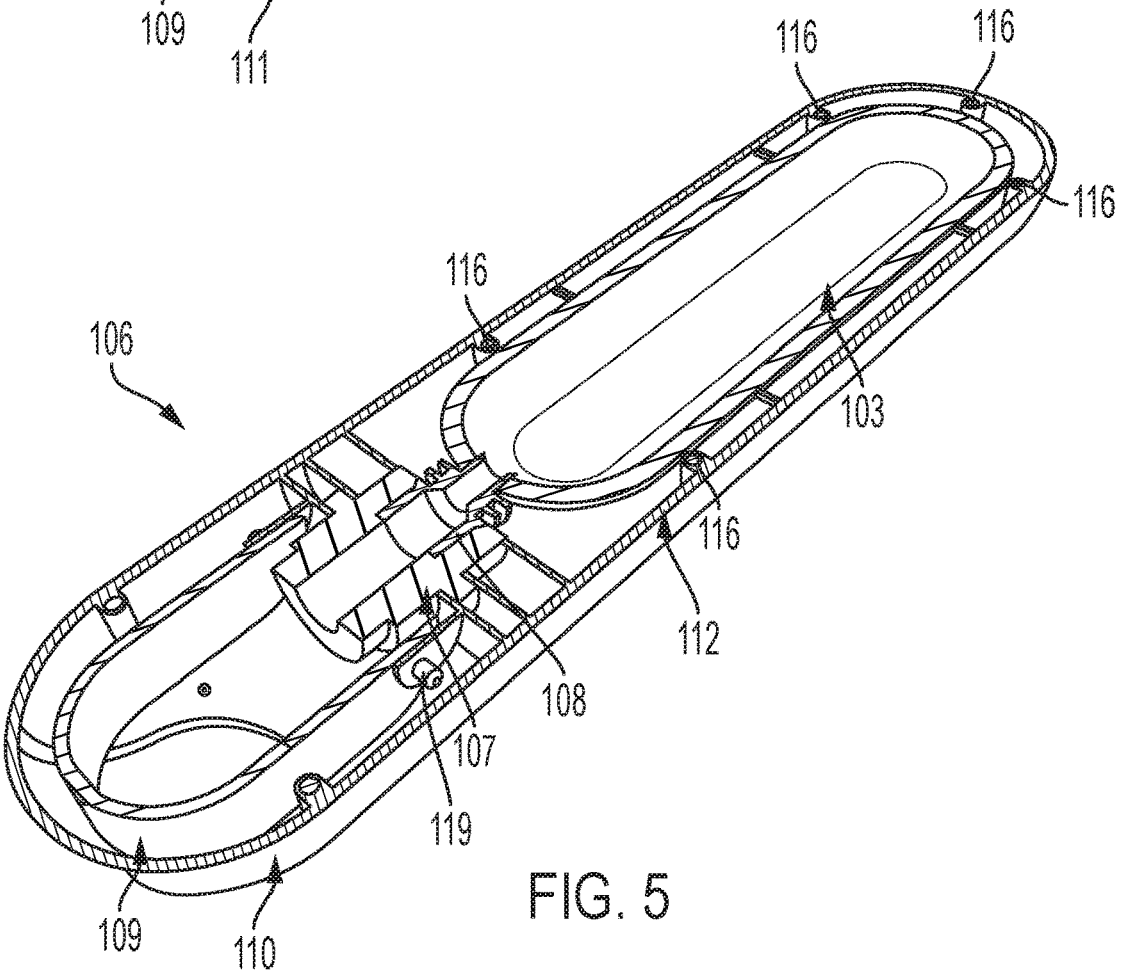
FIG. 5 shows a cross-sectional front perspective view of the toothpaste dispensing device.

Referencing FIGS. 4 and 5, the respective peripheral edges 112 may comprise respective collocating attractive magnetic fasteners causing the cover portion 110 to attach to the rear portion 111 by magnetic attraction.

The peripheral edges 112 may be coplanar.

Referencing FIGS. 6 and 7, the elongate interior 113 may be narrower front-to-back at the upper section 102 as compared to the lower section 104 and wherein the elongate interior 113 sufficient to conceal the toothpaste container 103 within the upper section 102 and the pump mechanism 107 and the trigger 109 within the lower section 104.

As is further shown in FIGS. 6 and 7, the pump mechanism 107 may be concealed above an upper edge of the toothbrush entrance 105 wherein the trigger 109 extends below the upper edge.

The pump mechanism 107 may comprise a mouth engagement which engages the mouth 108 of the toothpaste container 103.

In embodiments shown in FIG. 6, the toothpaste container 103 is a bespoke-type toothpaste container 103 which will be described in further detail below whereas in the embodiment shown in FIG. 7, the toothpaste container 103 is a conventional-type toothpaste container 103. In the embodiment of FIG. 6, the toothpaste container mouth 108 may insert into the mouth engagement whereas in the embodiment of FIG. 7, the toothpaste container mouth 108 may screw into the mouth engagement.

The pump mechanism 107 may be engaged by the rear portion 111 such that the pump mechanism 107 and the toothpaste container 103 can be simultaneously inserted into engage the rear portion 111 or removed from the rear portion 111 when the pump mechanism 107 and the toothpaste container 103 are connected.

As shown in FIG. 6, the rear portion 111 may define spaced apart ribs 117 on the pump mechanism 107 defines side projections 118 the tightly fit within the spaced apart ribs 117 to prevent movement of the pump mechanism 107 along an elongate axis of the body 101 in use. However, the ribs 117 are orientated orthogonally with respect to the elongate axis to allow the pump mechanism 107 to be pulled from the rear portion 111 with the toothpaste container 103 when the cover portion is removed.

The trigger 109 engage the pump mechanism 107 so that the trigger 109 can stay in place when the pump mechanism 107 is inserted or removed. Specifically, referencing FIG. 5, the trigger 109 may define side pivots 119 engage the rear portion 111 and, referencing FIG. 4, fulcrum engagements 120 that act on a lower face 121 of the pump mechanism 107. As such, when the trigger 109 is not activated, the fulcrum engagements 120 do not hinder the lower face 121 two interfere with the pump mechanism 107 from being removed.

Referencing FIGS. 6 and 7, the rear portion 111 may define rear spacer flanges 122 orientated orthogonally with respect to the elongate axis which bear on a rear surface of the toothpaste container 103 within the interior 113 in use.

In the embodiment wherein the toothpaste container 103 tapers as is shown in FIG. 7, the rear spacer flanges 122 may increase in height towards an upper end of the rear portion 111.

In embodiments, the toothpaste container 103 defines front and rear shell 123 which sealed together at a continuous peripheral edge 124. The peripheral edge 124 may be coplanar.

Referencing FIG. 4, the rear 111 may define opposing sides spacer flanges 125 which bear on the edge 124 of the toothpaste container 103 to position the toothpaste container 103 within the interior 113. In the embodiment shown in FIG. 4, the flanges bear both rearwardly on the toothpaste container 103 and on the edge 124 thereof.

As alluded to above, the pivot points 119 may be located away from the fulcrum engagements 120 such that, as the trigger 109 is deflected, the engagements 120 act reciprocally on the pump mechanism 107. The pump mechanism 107 may comprise portion squeezable together and which are biased apart to suck toothpaste from the toothpaste container 103.

Referencing FIG. 6, the body 101 may be of substantial uniform cross-section along a longitudinal axis thereof at along upper section 102.

The rear portion 111 may be adhered to a vertical wall surface using adhesive tape or the like. However, referencing FIG. 6, the rear portion 111 may comprise fastener apertures 126 therethrough for screw fix affixation.

Figure 9:
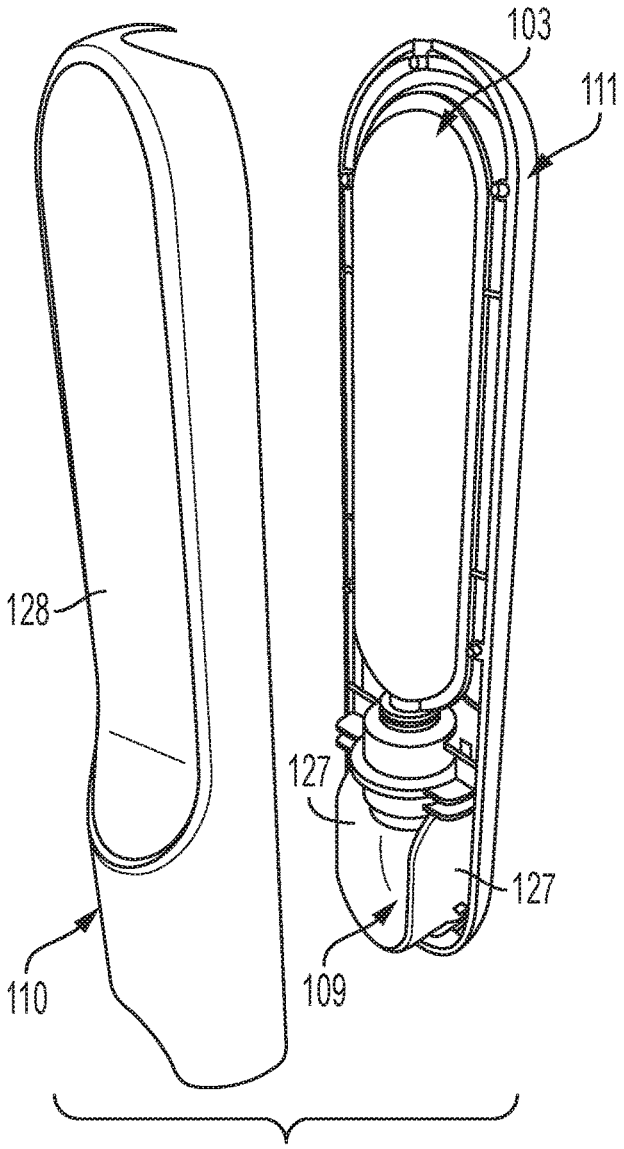
FIG. 9 shows the toothpaste dispensing device comprising the toothpaste container therein.
Figure 10:
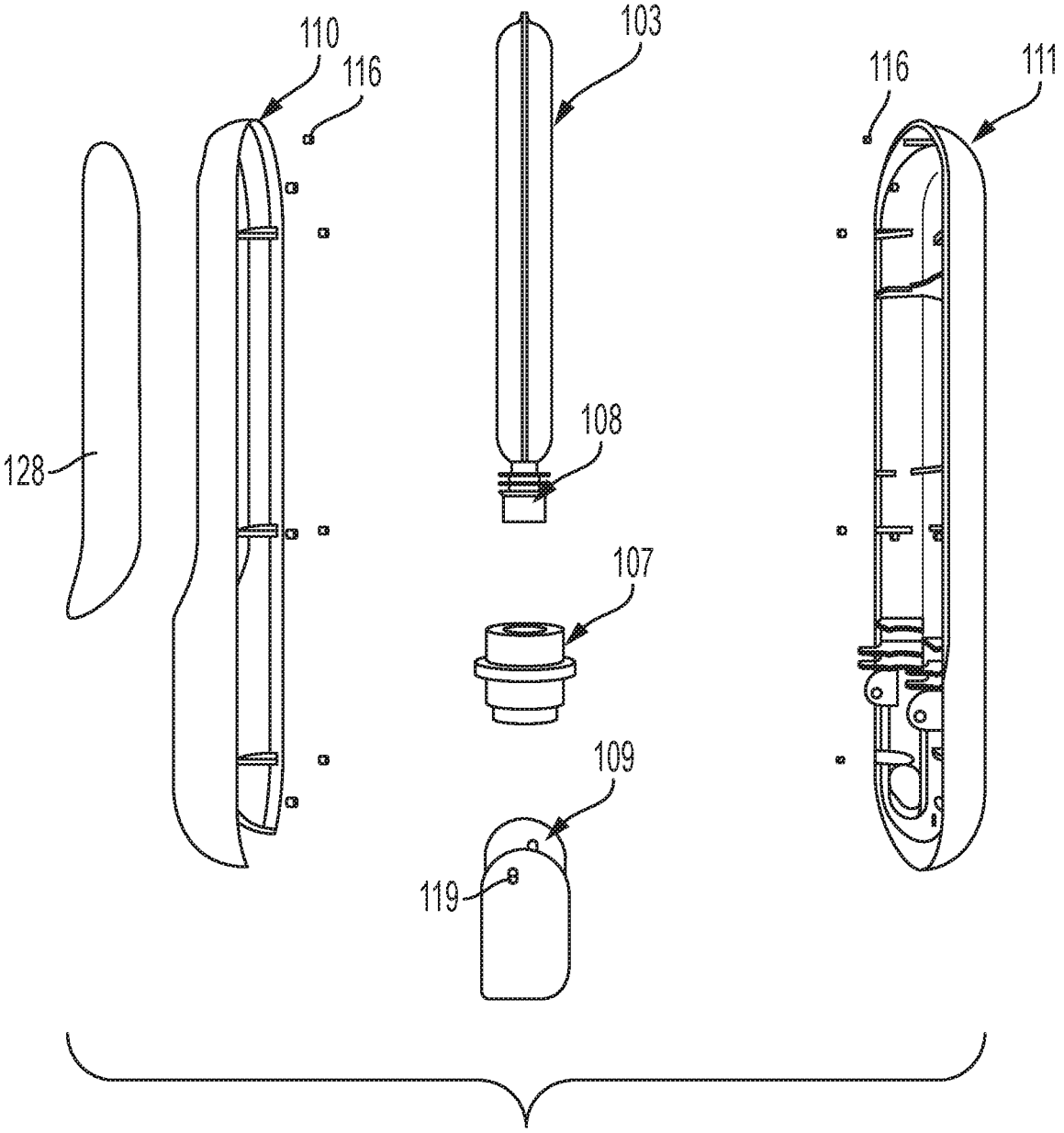
FIG. 10 shows an exploded view of the toothpaste dispensing device.

Referencing FIG. 9, the trigger 109 may be concave with respect to the toothbrush opening 105 and may define peripheral side edges 127.

Referencing FIG. 9, the cover portion 110 may define a façade plate engagement at the upper section 102 which reasonably engages a façade plate 128.

Figure 11:
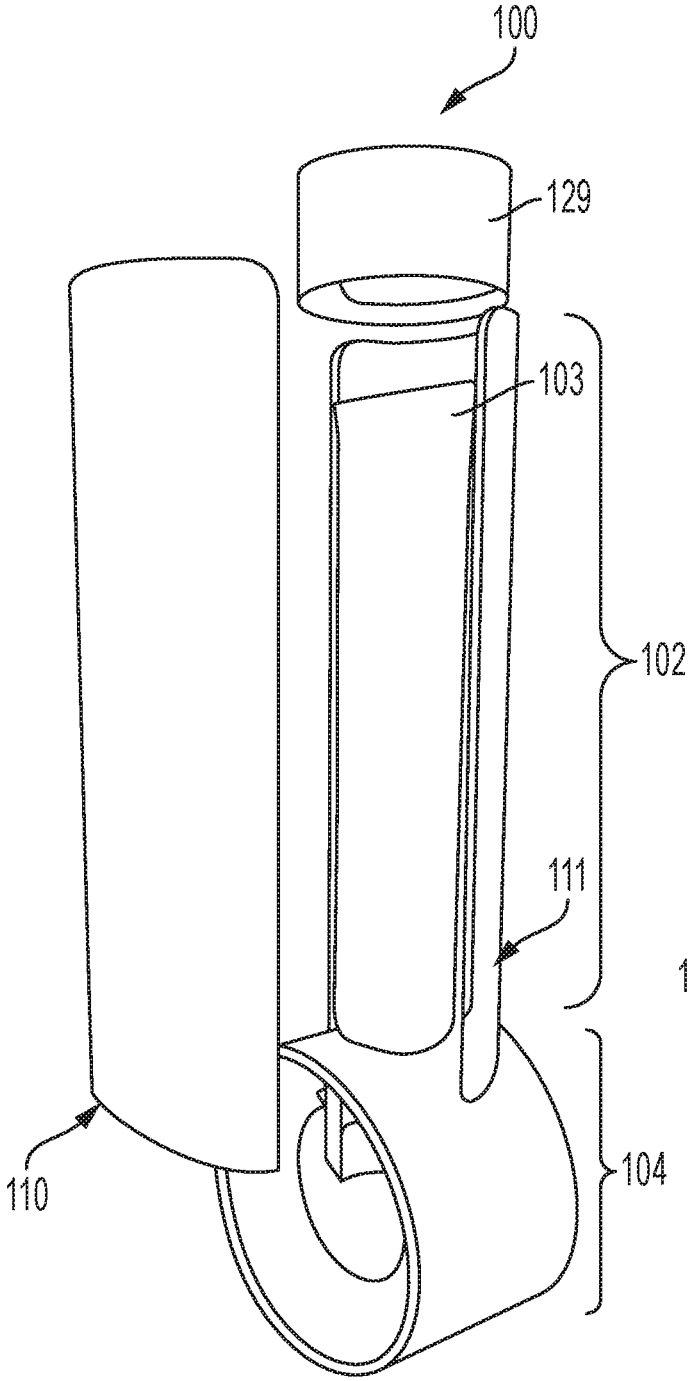
FIG. 11 shows a front perspective view of a toothpaste dispensing device in accordance with a further embodiment.

FIG. 11 shows a further embodiment of the device wherein the cover portion 110 forms part of the upper section 102 whereas the rear portion 111 entirely forms the lower section 104. In accordance with this embodiment, the cover portion 110 yet releasably connect to the rear portion 111 to entirely conceal the toothpaste container 103 therebetween. In accordance with this embodiment, the device 100 may further comprise a lid 129 which connects upper portions of the cover and rear portions 110, 111.

Figure 12:
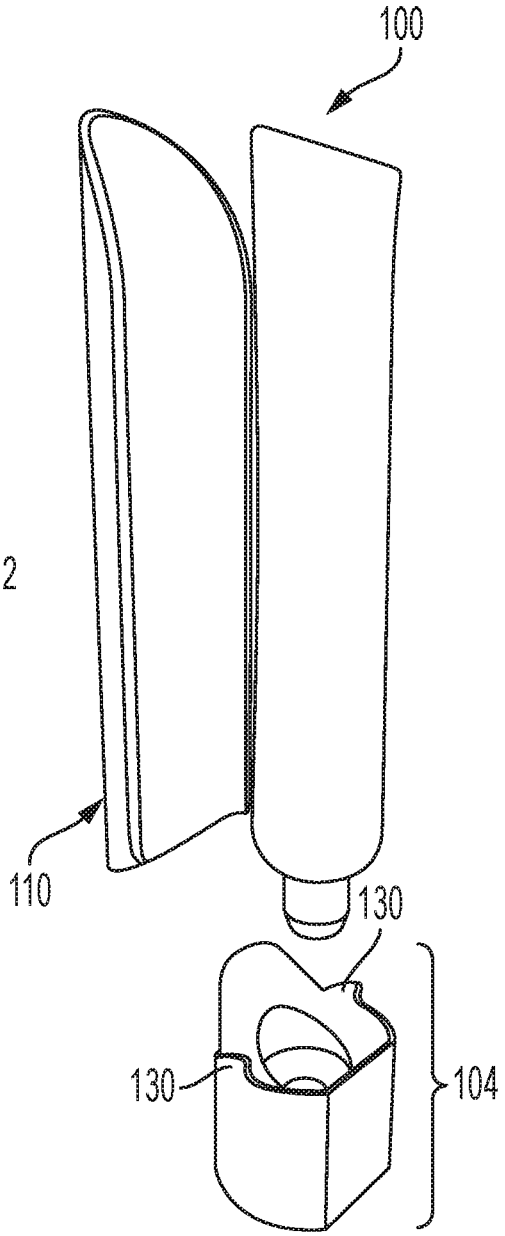
FIG. 12 shows a front perspective view of a toothpaste dispensing device in accordance with a yet further embodiment.

FIG. 12 shows a yet further embodiment of the device 100 wherein the upper section 102 comprises the cover portion 110 which is pivotally coupled to a lower section 104 at pivot points 130. The cover portion 110 has curvature so as to conceal the toothpaste container 103 therebehind and is operably coupled to the dispensing mechanism 107 of the lower section 104. As such, dispensing toothpaste from the toothpaste container 103 comprises pulling the cover portion 110 to pivot the cover portion 110 with respect to the lower section 104 to cause the dispensing mechanism 107 dispense toothpaste.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The term "approximately" or similar as used herein should be construed as being within 10% of the value stated unless otherwise indicated.

The invention claimed is:

1. A toothpaste dispensing device comprising: an elongate body defining:

an upper section for accommodating at least a portion of a toothpaste container longitudinally therein in use; and a lower section defining a toothbrush entrance therethrough and a dispensing mechanism located within the lower section, the dispensing mechanism comprising:

a pump mechanism engaging a mouth of the toothpaste container; and a trigger pivotally coupled to act on the pump mechanism, the trigger accessible via the toothbrush entrance such that, in use, when a toothbrush head is inserted into the toothbrush entrance, the toothbrush head deflects the trigger thereby causing the trigger to act on the pump mechanism to dispense toothpaste from the toothpaste container onto the toothbrush head located thereunderneath, wherein:

the body comprises a cover portion and a rear portion which releasably connect at respective peripheral edges thereof;

the cover portion defines the toothbrush entrance;

the cover and rear portions define an elongate interior therebetween when connected;

the elongate interior is sufficient to completely accommodate the toothpaste container within the peripheral edges therein in use when the cover and rear portions are connected, the rear portion defines a rear planar surface at least rearward of the trigger for conforming attachment to a vertical surface in use;

wherein the cover and rear portions magnetically attract each other wherein respective peripheral edges of the cover and rear portions comprise respective collocating attractive magnetic fasteners causing the cover portion to attach to the rear portion by magnetic attraction, and wherein the cover portion defines an edge which can be pulled and wherein the cover portion releases from the rear portion when the edge is pulled;

wherein the pump mechanism comprises a mouth engagement which engages the mouth and wherein the pump mechanism is engaged by the rear portion such that the pump mechanism and the toothpaste container can be simultaneously inserted to engage the rear portion or removed from the rear portion when the pump mechanism and the toothpaste container are connected;

wherein the trigger engages the pump mechanism so that the trigger can stay in place when the pump mechanism is inserted or removed; and wherein the trigger defines side pivots that engage the rear portion and fulcrum engagements that acts reciprocally on a lower face of the pump mechanism and wherein, when the trigger is not activated the fulcrum engagements does not hinder the lower face to interfere with the pump mechanism being removed.

2. The device as claimed in claim 1, wherein the rear planar surface is along substantially the entire length of the rear portion.

3. The device as claimed in claim 1, wherein the edge is defined by an edge of the toothbrush entrance.

4. The device as claimed in claim 3, wherein the edge is defined by an upper edge of the toothbrush entrance.

5. The device as claimed in claim 1, wherein the peripheral edges are coplanar.

6. The device as claimed in claim 1, wherein the elongate interior is narrower front-to-back at the upper section as compared to at the lower section and wherein the elongate interior is sufficient to conceal the toothpaste container within the upper section and pump mechanism and the trigger therein within the lower section.

7. The device as claimed in claim 1, wherein the toothbrush entrance defines an upper edge and wherein the pump mechanism is concealed above the upper edge and wherein the trigger extends below the upper edge.

8. The device as claimed in claim 1, wherein the rear portion defines spaced apart ribs and wherein the pump mechanism defines sides projections that tightly fit within the spaced apart ribs to prevent movement of the pump mechanism along an elongate axis of the body in use and wherein the ribs are orientated orthogonally with respect to the elongate axis to allow the pump mechanism to be pulled from the rear portion when the cover portion is removed.

9. The device as claimed in claim 1, wherein the mouth engagement screwably engages the mouth.

10. The device as claimed in claim 1, wherein the rear portion defines rear spacer flanges orientated orthogonally with respect to the elongate axis which bear on a rear surface of the toothpaste container to position the toothpaste container within the interior in use.

11. The device as claimed in claim 10, wherein the rear portion defines a plurality of rear spacer flanges which increase in height towards an upper end of the rear portion.

12. The device as claimed in claim 11, wherein the upper section is of uniform cross-section along a portion of a longitudinal axis of the body.

13. The device as claimed in claim 1, wherein the toothpaste container defines front and rear shell which seal together at a continuous peripheral edge.

14. The device as claimed in claim 13, wherein the continuous peripheral edge is coplanar.

15. The device as claimed in claim 13, wherein the rear defines opposing side spacer flanges which bear on the edge of the toothpaste container to position the toothpaste container within the interior.

16. The device as claimed in claim 13, wherein the toothpaste container is made by a dry fibre moulding process.

17. The device as claimed in claim 1, wherein the trigger is operably coupled to the body at pivot points and which comprise fulcrum engagements engaging the pump mechanism, the engagements located away from the pivot points such that as the trigger is deflected, the engagements act reciprocally on the pump mechanism.

18. The device as claimed in claim 17, wherein the pump mechanism comprises portions squeezable together and which are biased apart to suck toothpaste from the toothpaste container.

19. The device as claimed in claim 17, wherein the engagements act on a lower face of the pump mechanism.

20. The device as claimed in claim 1, wherein the rear portion comprises fastener apertures therethrough.

21. The device as claimed in claim 1, wherein the trigger is concave and defines a peripheral side edges facing the toothbrush entrance.

22. The device as claimed in claim 1, wherein the cover portion defines a façade plate engagement at the upper section which releasably engages a façade plate.

23. A method of using a toothpaste dispensing device as claimed in claim 1, the method comprising affixing the rear portion to a vertical surface, completely concealing a toothpaste container within an interior defined between the cover portion and the rear portion and pulling the front portion from the rear portion to reveal the toothpaste container for removal.

24. A method as claimed in claim 23, further comprising pulling the front portion from the rear portion by an edge defined by the front portion.

25. A method as claimed in claim 24, wherein the edge is defined by the toothbrush entrance.

26. A method as claimed in claim 23, wherein the method further comprises removing the pump mechanism and the toothpaste container whilst the toothpaste container is connected to the pump mechanism.

* * * * *